US006792682B2

(12) United States Patent
Follo et al.

(10) Patent No.: US 6,792,682 B2
(45) Date of Patent: Sep. 21, 2004

(54) RAZOR CARTRIDGE WITH SHAVING AID

(75) Inventors: Thomas A. Follo, North Milford, CT (US); Paul R. Dansreau, Shelton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/324,245

(22) Filed: Dec. 19, 2002

(65) Prior Publication Data

US 2003/0115756 A1 Jun. 26, 2003

Related U.S. Application Data

(60) Provisional application No. 60/343,481, filed on Dec. 21, 2001.

(51) Int. Cl.[7] ..... B26B 21/14
(52) U.S. Cl. ..... 30/50; 30/77
(58) Field of Search ..... 30/50, 77–79, 30/84, 81

(56) References Cited

U.S. PATENT DOCUMENTS

| | | | | |
|---|---|---|---|---|
| 4,170,821 A | | 10/1979 | Booth | 30/41 |
| 5,056,222 A | | 10/1991 | Miller et al. | 30/77 |
| 5,070,612 A | * | 12/1991 | Abatemarco | 30/50 |
| 5,689,883 A | | 11/1997 | Ortiz et al. | 30/34.2 |
| D424,744 S | | 5/2000 | Coffin et al. | D28/47 |
| 6,112,412 A | | 9/2000 | Richard | 30/41.5 |
| 6,138,361 A | | 10/2000 | Richard et al. | 30/50 |
| 6,167,625 B1 | | 1/2001 | King et al. | 30/34.2 |
| 6,308,416 B1 | | 10/2001 | Bosy et al. | |

FOREIGN PATENT DOCUMENTS

| | | |
|---|---|---|
| EP | 0 858 868 A | 8/1998 |
| WO | WO 95 05272 A | 2/1995 |

* cited by examiner

*Primary Examiner*—Douglas D Watts
(74) *Attorney, Agent, or Firm*—McCormick, Paulding & Huber LLP

(57) ABSTRACT

A razor cartridge is provided that includes a seat, a cap, one or more razor blades, and a relief centrally located in an aft face of the cap. The relief enables the user to get the cutting edges of the one or more razor blades in closer proximity to a feature (e.g., a nose) than is possible using currently available razor cartridges. In a preferred embodiment of the cartridge, a shaving aid strip is disposed in the contact face, positioned aft of the forward face of the cap and forward of the relief. The shaving aid strip preferably reflects the contour of the aft face of the cartridge that includes the relief.

11 Claims, 2 Drawing Sheets

RAZOR CARTRIDGE WITH SHAVING AID

CROSS-REFERENCE TO RELATED APPLICATION

This application claims priority form U.S. provisional application No. 60/343,481 filed on Dec. 21, 2001.

BACKGROUND OF THE INVENTION

1. Technical Field

This invention relates to shaving devices in general, and to shaving devices that utilize a shaving aid disposed in the cartridge in particular.

2. Background Information

Modern safety razors include a plurality of blades disposed within a cartridge that is pivotally or rigidly mounted on a handle. Some safety razors have a disposable cartridge for use with a reusable handle, while others have a handle and cartridge that are combined into a unitary disposable. Although a variety of razor cartridge configurations exist, most include a frame made of a rigid plastic that includes a seat and a cap. Cartridges often include a guard disposed forward of the blades. The guard and the cap orient the position of the person's skin relative to the blades to optimize the shaving action of the blade. Some cartridges include a comfort strip comprised of shaving aids (e.g., lubricating agents, drag reducing agents, depilatory agents, cleaning agents, medicinal agents, etc.) to enhance the shaving process. The terms "forward" and "aft", as used herein, define relative position between features of the safety razor (i.e., razor assembly). A feature "forward" of the razor blades, for example, is positioned so that the surface to be shaved encounters the feature before it encounters the razor blades, if the razor assembly is being stroked in its intended cutting direction (e.g., the guard is forward of the razor blades). A feature "aft" of the razor blades is positioned so that the surface to be shaved encounters the feature after it encounters the razor blades, if the razor assembly is being stroked in its intended cutting direction (e.g., the cap is disposed aft of the razor blades).

The comfort and performance provided by a particular razor are critical to the commercial success of the razor. Improvements that benefit razor comfort, performance, and ease of use, however significant or subtle, can have a decided impact on the commercial success of a razor. For example, the usable life of a cartridge is often limited by the usable life of the comfort strip. Once the comfort strip is consumed, it generally believed that the razor must also be in need of replacement. In fact, razor blades within currently available razor assemblies are very often still fit for use after the comfort strip has been consumed.

What is needed, therefore, is a razor assembly cartridge that can be used for an extended period of time, and thereby provide a desirable perception of quality.

DISCLOSURE OF THE INVENTION

It is, therefore, an object of the present invention to provide a razor assembly cartridge that provides a desirable perception of quality.

According to the present invention, a razor cartridge is provided that includes a seat, a cap, one or more razor blades, and a relief centrally located in an aft face of the cap. The relief enables the user to get the cutting edges of the one or more razor blades in closer proximity to a feature (e.g., a nose) than is possible using currently available razor cartridges. In a preferred embodiment of the cartridge, a shaving aid strip is disposed in the contact face, positioned aft of the forward face of the cap and forward of the relief. The shaving aid strip preferably reflects the contour of the aft face of the cartridge that includes the relief.

The present invention razor cartridge can alternatively be described as having a seat, a cap, one or more razor blades, a first cap extension, and a second cap extension. The first and second cap extensions extend out from an aft face of the cap, one on each side of the widthwise-extending centerline of the cartridge. The first cap extension and the second cap extension are spaced apart from one another, thereby creating a centrally located relief. In the preferred embodiment, the shaving aid strip extends into the first and second cap extensions.

One advantage of the present invention is that it enables users to shave closer to features extending out from the surface to be shaved. The relief centrally located within the aft surface of the cap decreases the distance between the feature and the razor blades. As a result, it is possible to shave closer to the feature and thereby provide a more desirable shave.

Another advantage of the present invention is that the usable life of the shaving aid strip is increased relative to shaving aid strips used in many currently available razor assemblies. The extension of the shaving aid strip into the regions outside of the relief, or alternatively into the cap extensions, increases the surface area of the shaving aid strip. As a result, the usable life of the strip is favorably extended.

These and other objects, features, and advantages of the present invention will become apparent in light of the detailed description of the present invention.

DETAILED DESCRIPTION OF THE INVENTION

Figure 1:
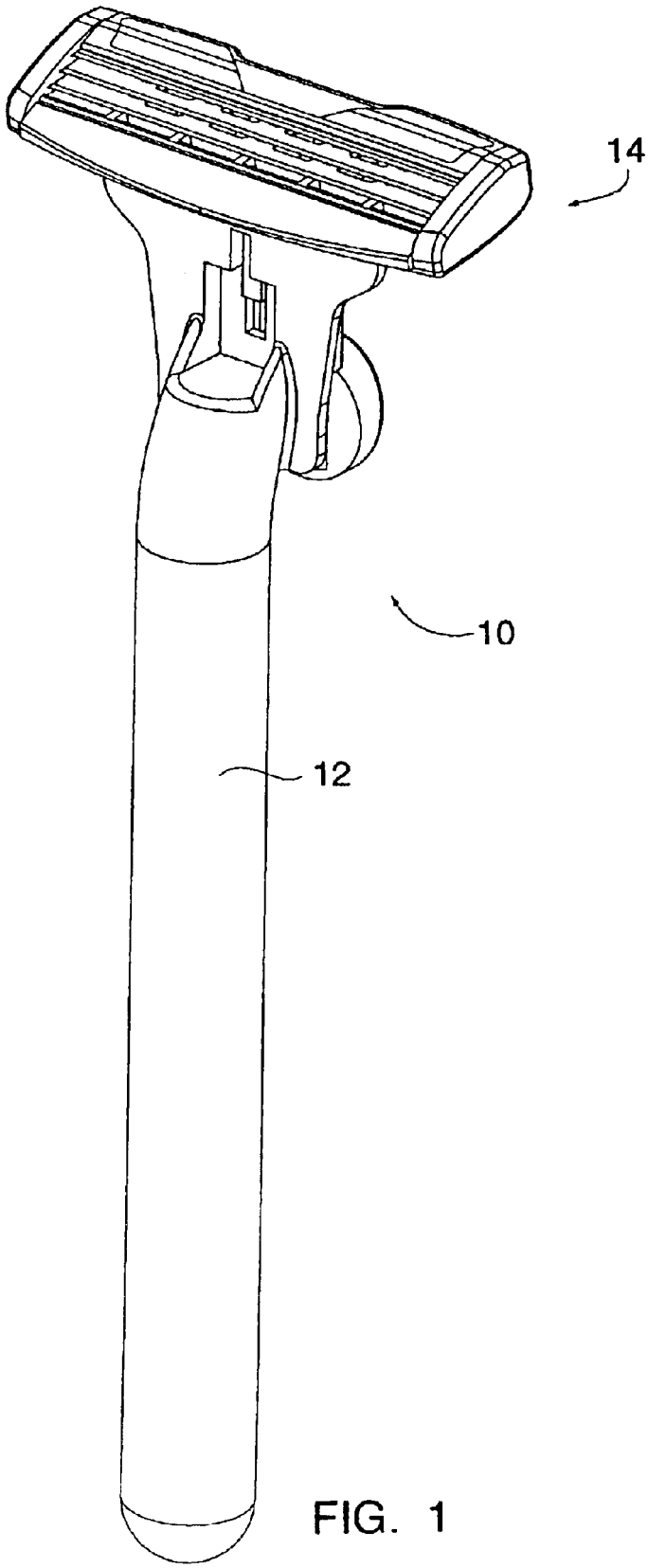
FIG. 1 is a perspective view of a present invention razor assembly.

Referring to FIG. 1, a razor assembly 10 includes a handle 12 and a cartridge 14. The handle 12 can be rigidly or pivotally attached to the cartridge 14. The cartridge 14 can be a disposable cartridge for use with a reusable handle, or the handle 12 and cartridge 14 can be combined into a unitary disposable razor assembly.

Figure 2:
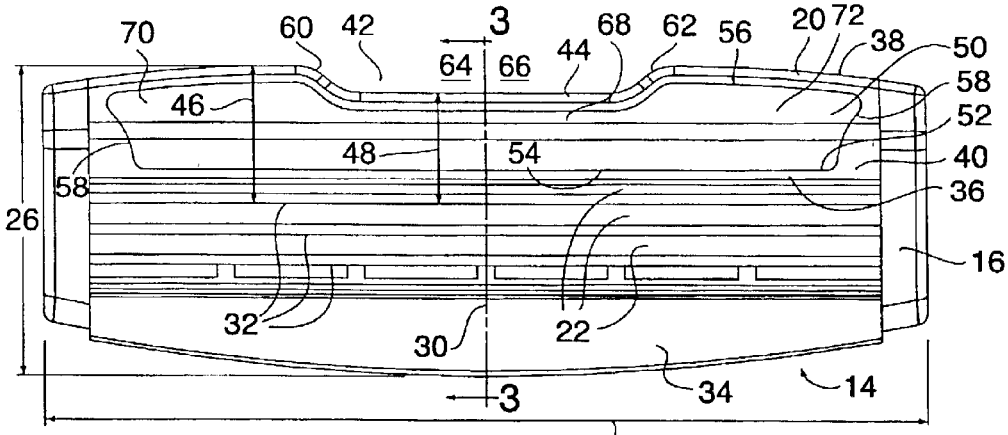
FIG. 2 is a planar view of a razor assembly cartridge showing a first embodiment of a shaving aid strip.
Figure 3:
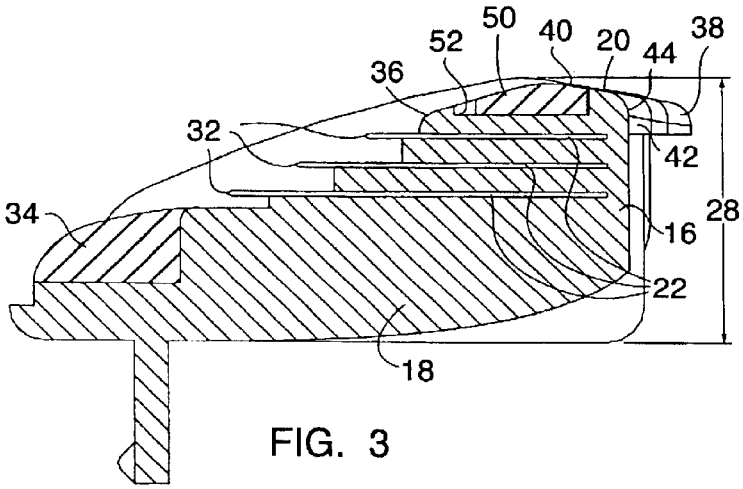
FIG. 3 is a sectional view of the razor assembly cartridge sectioned along line 3—3 of FIG. 2.

Referring to FIGS. 2 and 3, the cartridge 14 includes a frame 16 having a seat 18 and a cap 20, and one or more razor blades 22 disposed between the seat 18 and the cap 20. The cartridge 14 has a length 24, a width 26, a height 28, and a widthwise-extending centerline 30. The razor blades 22 each have a lengthwise-extending cutting edge 32. Depending upon the application, the cartridge 14 may also include a guard 34 attached to the frame 16. Guards 34 are well known in the art and will therefore not be discussed further here other than to say the present invention is not limited to being used with any particular type of guard.

In the exemplary embodiment shown in FIGS. 2 and 3, the cap 20 includes a lengthwise-extending forward face 36, a lengthwise-extending aft face 38, and a contact face 40 extending between the forward face 36 and the aft face 38. A relief 42 having a base surface 44 is centrally located in the aft face 38 of the cap 20. In some embodiments, the relief 42 can extend into the frame 16 as well as the cap 18. The aft face 38 of the cap 20 is separated from the cutting edge 32 of the aft-most razor blade 22 by a first distance 46. The base surface 44 of the relief 42 is separated from the cutting edge 32 of the aft-most razor blade 22 by a second distance 48. The first distance 46 is greater than the second distance 48. In some embodiments, the aft face 38 of the cap 20 is not parallel to the cutting edge 32 of the aft-most razor blade 22. In those embodiments, the first distance 46 between the aft face 38 of the cap 20 and the cutting edge 32 of the aft-most razor blade 22 is typically greater than the second distance 48 at every position along the length 24 of the cartridge 14, or at least at a majority of the positions along the length 24 of the cartridge 14.

Figure 4:
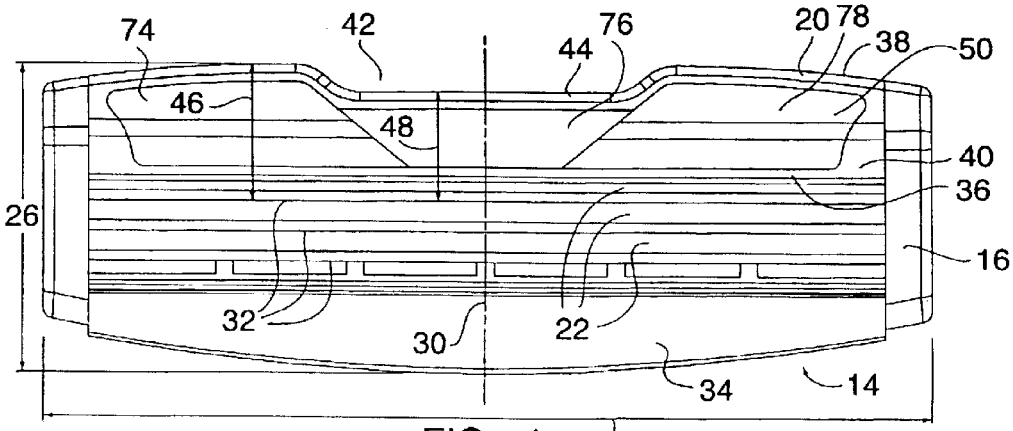
FIG. 4 is a planar view of a razor assembly cartridge showing a second embodiment of a shaving aid strip.

Referring to FIGS. 2–4, and the cartridge 14 includes a shaving aid strip 50 (sometimes referred to as a "comfort strip") disposed in a pocket 52 within the contact surface 40 of the cap 20. The shaving aid strip 50 can be attached to the cap 20 by known means (e.g., pins, mechanical fasteners, adhesives, etc.). The shaving aid strip 50 and the pocket 52 are positioned aft of the forward face 36 of the cap 20 and forward of the relief 42. The shaving aid strip 50 need not be disposed in a pocket 52, and can be attached to the contact face 40 of the cap 20. The shaving aid strip 50 can include one or more of a variety of constituent materials such as lubricating agents, drag reducing agents, depilatory agents, cleaning agents, medicinal agents, etc., and the present invention should not be construed as being limited to any single material or combination of materials.

The shaving aid strip 50 shown in FIG. 2 has a geometry that includes a first edge 54 adjacent the razor blades 22, a second edge 56 adjacent the aft face 38 of the cap 20, and a pair of side edges 58, each extending between the first and second edges 54,56. The first edge 54 preferably extends parallel to the razor blade cutting edges 32. The second edge 56 preferably follows the contour of the aft face 38. The resulting shaving aid strip geometry provides an increased amount of shaving aid surface area along the contact face 40 of the cap 20 as compared to shaving aid strips 50 that are rectangularly shaped. The additional shaving aid strip surface increases the usable life of the shaving aid strip 50 and therefore the usable life of the razor assembly 10.

The present invention razor cartridge 14 can be described alternatively as having a seat 18, a cap 20, one or more razor blades 22, a first cap extension 60, and a second cap extension 62. As described above, the cap 20 includes a lengthwise-extending forward face 36, a lengthwise-extending aft face 38, and a contact face 40 extending between the forward face 36 and the aft face 38, and the one or more razor blades 22 are disposed between the seat 18 and the cap 20. The first cap extension 60 extends out from the aft face 36 on a first side 64 of the widthwise-extending centerline 30. The second cap extension 62 extends out from the aft face 38 on a second side 66 of the widthwise-extending centerline 30. The first side 64 and the second side 66 are opposite sides of the widthwise-extending centerline 30, and the first cap extension 60 and the second cap extension 62 are spaced apart from one another. As described above, the cartridge 14 includes a shaving aid strip 50 disposed in a pocket 52 within the contact face 40 of the cap 20, or attached to the contact face 20. The constituent materials are the same as those disclosed above. In this alternatively described embodiment, the shaving aid strip 50 geometry includes a first portion 68, a second portion 70, and a third portion 72. The first portion 68 is positioned adjacent the razor blades 22, and extends lengthwise across substantially all of the cap 20. The second portion 70 extends from the first portion 68 into the first cap extension 60. The third portion 72 extends from the first portion 68 into the second cap extension 62. Here again, the resulting shaving aid strip geometry provides an increased amount of shaving aid surface area along the contact face 40 of the cap 20 as compared to prior art shaving aid strips that are rectangularly shaped. The additional shaving aid strip surface increases the usable life of the shaving aid strip 50 and therefore the usable life of the razor assembly 10.

Referring to FIG. 4, the shaving aid strip 50 may alternatively consist of a first side section 74, a center section 76, and a second side section 78. Each side section 74,78 extends from the first edge 54 adjacent the razor blades 22 to the second edge 56 adjacent the aft face 38 of the cap 20. The center section 76 is disposed between the side sections 74,78. The center section 76 may include constituent materials different than those in the side sections 74,78, or vice versa. The center section 76 may also consist of a non-shaving aid material. In addition or alternatively, the contour of the center section 76 may be different than those of the side sections 74,78.

Although this invention has been shown and described with respect to the detailed embodiments thereof, it will be understood by those skilled in the art that various changes in form and detail thereof may be made without departing from the spirit and scope of the invention.

What is claimed is:

1. A razor cartridge having a length and width, comprising:

a seat;

a cap having a lengthwise extending forward face, a lengthwise extending aft face, and a contact face extending between the forward face and the aft face;

one or more razor blades, each have a lengthwise extending cutting edge, disposed between the seat and the cap;

a relief centrally located in the aft face of the cap; and a shaving aid strip disposed in the contact face, positioned aft of the forward face and forward of the relief.

2. The razor cartridge of claim 1, wherein the shaving aid strip comprises:

a first edge adjacent the one or more razor blades;

a second edge adjacent the aft face of the cap; and a pair of side edges that extend between the first and second edges;

wherein the first edge extends parallel to the cutting edges of the one or more razor blades, and the second edge follows the contour of the aft face.

3. A razor cartridge having a length and a width, comprising:

a seat;

a cap having a lengthwise extending forward face, a lengthwise extending aft face, and a contact face extending between the forward face and the aft face;

one or more razor blades, each have a lengthwise extending cutting edge, disposed between the seat and the cap;

a relief centrally located in the aft face of the cap, the relief further including a base surface;

wherein the aft face of the cap is separated from the cutting edge of the aft-most razor blade by a first distance, and the base surface of the relief is separated from the cutting edge of the aft-most razor blade by a second distance; and wherein the first distance is greater than the second distance.

4. The razor cartridge of claim 3, further comprising:

a shaving aid strip attached to the contact face, positioned aft of the forward face and forward of the relief.

5. A razor cartridge having a length and a width, comprising:

a seat;

a cap having a lengthwise extending forward face, a lengthwise extending aft face, and a contact face extending between the forward face and the aft face;

one or more razor blades, each have a lengthwise extending cutting edge, disposed between the seat and the cap; and a relief centrally located in the aft face of the cap, the relief further including a base surface; and wherein the aft face of the cap is separated from the cutting edge of the aft-most razor blade by a first distance, and the base surface of the relief is separated from the cuffing edge of the aft-most razor blade by a second distance; and wherein the first distance is greater than the second distance along substantially all of the length of the cartridge.

6. A razor cartridge having a length, a width, and a widthwise-extending centerline, wherein the cartridge comprises:

a seat;

a cap having a lengthwise extending forward face, a lengthwise extending aft face, and a contact face extending between the forward face and the aft face;

one or more razor blades, each have a lengthwise extending cutting edge, disposed between the seat and the cap;

a first cap extension extending out from the aft face on a first side of the widthwise-extending centerline; and a second cap extension extending out from the aft face on a second side of the widthwise-extending centerline, wherein the first side and the second side are opposite sides of the widthwise-extending centerline, and the first cap extension and the second cap extension are spaced apart from one another; and a shaving aid strip disposed in the contact face, positioned aft of the forward face and forward of the relief.

7. The razor cartridge of claim 6, wherein the shaving aid strip comprises:

a first portion positioned adjacent the razor blades, and extending lengthwise across substantially all of the cap;

a second portion extending from the first portion into the first cap extension; and a third portion extending from the first portion into the second cap extension.

8. A razor assembly, comprising:

a cartridge having:

a length;

a width;

a cap having a lengthwise extending forward face, a lengthwise extending aft face, and a contact face extending between the forward face and the aft face;

one or more razor blades, each have a lengthwise extending cutting edge, disposed between the seat and the cap;

a relief centrally located in the aft face of the cap; and a handle attached to the cartridge; and a shaving aid strip attached to the contact face, positioned aft of the forward face and forward of the relief.

9. The razor assembly of claim 8, wherein the shaving aid strip is disposed in the contact face.

10. The razor assembly of claim 9, wherein the shaving aid strip comprises:

a first edge adjacent the one or more razor blades;

a second edge adjacent the aft face of the cap; and a pair of side edges that extend between the first and second edges;

wherein the first edge extends parallel to the cutting edges of the one or more razor blades, and the second edge follows the contour of the aft face.

11. The razor assembly of claim 10, wherein the relief further includes a base surface; and wherein the aft face of the cap is separated from the cutting edge of the aft-most razor blade by a first distance, and the base surface of the relief is separated from the cutting edge of the aft-most razor blade by a second distance; and wherein the first distance is greater than the second distance.

* * * * *